US008960149B2

(12) United States Patent
Sugishita et al.

(10) Patent No.: US 8,960,149 B2
(45) Date of Patent: Feb. 24, 2015

(54) TWO-CYCLE ENGINE

(75) Inventors: Yuu Sugishita, Saitama (JP); Mikio Suzuki, Tokyo (JP); Syouta Takeshima, Saitama (JP)

(73) Assignee: Husqvarna Zenoah Co., Ltd, Saitama (JP)

( * ) Notice: Subject to any disclaimer, the term of this patent is extended or adjusted under 35 U.S.C. 154(b) by 405 days.

(21) Appl. No.: 13/393,625

(22) PCT Filed: Sep. 1, 2009

(86) PCT No.: PCT/JP2009/065242
§ 371 (c)(1),
(2), (4) Date: Apr. 6, 2012

(87) PCT Pub. No.: WO2011/027416
PCT Pub. Date: Mar. 10, 2011

(65) Prior Publication Data

US 2012/0180769 A1 Jul. 19, 2012

(51) Int. Cl.

| | |
|---|---|
| ***F02B 75/06*** | (2006.01) |
| ***F02F 3/26*** | (2006.01) |
| ***F02F 7/00*** | (2006.01) |
| *F02B 75/02* | (2006.01) |

(52) U.S. Cl.
CPC ..... *F02F 3/26* (2013.01); *F02F 7/0019* (2013.01); *F02B 2075/025* (2013.01)
USPC ..... 123/192.2; 123/197.4

(58) Field of Classification Search
CPC ..... F16F 15/22; F16F 15/24; F16F 15/26; F16F 15/28; F02B 41/04; F02B 75/06; F02B 75/20; F02B 75/32
USPC ..... 123/192.1, 192.2, 197.1, 197.4
See application file for complete search history.

(56) References Cited

U.S. PATENT DOCUMENTS

| | | | | |
|---|---|---|---|---|
| 1,956,804 | A * | 5/1934 | Meyer | 123/197.4 |
| 2,974,541 | A * | 3/1961 | Dolza | 123/192.2 |
| 3,286,535 | A * | 11/1966 | Schrader | 74/44 |
| 4,945,866 | A * | 8/1990 | Chabot, Jr. | 123/53.1 |
| 5,076,220 | A * | 12/1991 | Evans et al. | 123/197.4 |

(Continued)

FOREIGN PATENT DOCUMENTS

| | | |
|---|---|---|
| JP | 2149731 | 6/1990 |
| JP | 7150969 | 6/1995 |
| JP | 8144780 | 6/1996 |

(Continued)

*Primary Examiner* — Noah Kamen
(74) *Attorney, Agent, or Firm* — Nelson Mullins Riley & Scarborough LLP

(57) ABSTRACT

A two-cycle engine having a structure in which the shaft center $C_{cy}$ of the cylinder 3 is offset onto the exhaust port 32 side with respect to the rotational center $C_{cr}$ of the crankshaft 4, and the offset amount S of the shaft center $C_{cy}$ with respect to the rotational center $C_{cr}$ is set greater than 1 mm and less than 6 mm. Furthermore, in this case, the center of gravity of the counterweight 42 of the crankshaft 4 is shifted onto the rear side in the rotational direction with respect to the line passing the rotational center $C_{cr}$ of the crankshaft 4 and the center $C_{cp}$ of the crank pin 41.

2 Claims, 6 Drawing Sheets

(56) References Cited

U.S. PATENT DOCUMENTS

| | | | | | |
|---|---|---|---|---|---|
| 5,186,127 | A * | 2/1993 | Cuatico | 123/197.4 |
| 5,816,201 | A * | 10/1998 | Garvin | 123/197.3 |
| 6,058,901 | A * | 5/2000 | Lee | 123/197.1 |
| 6,745,746 | B1 * | 6/2004 | Ishii | 123/197.4 |

FOREIGN PATENT DOCUMENTS

| | | | |
|---|---|---|---|
| JP | 11236832 | | 8/1999 |
| JP | 2005331006 | | 12/2005 |
| JP | 2006283571 | | 10/2006 |
| JP | 2009115033 | A * | 5/2009 |

* cited by examiner

TWO-CYCLE ENGINE

FIELD OF THE INVENTION

The present invention pertains to a two-cycle engine and relates to a single cylinder two-cycle engine used, for example, in a portable working machine.

BACKGROUND OF THE INVENTION

Previous single cylinder two-cycle engines have a structure in which the shaft center of a cylinder is offset onto the exhaust side thereof with respect to the rotational center of a crankshaft (for example, Patent Document 1 and 2).

In such a two-cycle engine, because the rotational center of the crankshaft is located at an offset position extending from a connecting rod (hereinafter, referred to as a "con.rod") in a position such that the con.rod becomes parallel to the shaft center of the cylinder, the height from the rotational center of the crankshaft to the location of the top dead center of a piston may be slightly minimized, contributing to downsizing. Furthermore, the shaft center of the cylinder is offset onto the exhaust side, lowering the side pressure of the sliding surface of the cylinder and the piston on the exhaust side, and preventing seizures or abnormal wear by favorably maintaining the lubrication on the exhaust side where the temperature becomes high.

PRIOR TECHNICAL DOCUMENT

Patent Documents

Patent Document 1: Japanese Unexamined Patent Application Publication No. S54-89115

Patent Document 2: Japanese Unexamined Patent Application Publication No. H2-149731

SUMMARY OF THE INVENTION

Problem to be Solved by the Invention

As described, in conventional two-cycle engines having an offset structure, the offset amount was determined for the purpose of downsizing the engine or effectively preventing seizures.

However, the inventor of the present invention has discovered that the offset affects not only downsizing or prevention of seizures but also improves the output and exhaust gas emissions depending on the amount. Therefore, it has been desired to determine the most suitable offset amount that makes it possible to fully invoke these effects.

The purpose of the present invention is to provide a two-cycle engine having an offset structure capable of improving both the output and emissions.

Means of Solving the Problem

The two-cycle engine in the present invention is a two-cycle engine with a structure in which the shaft center of a cylinder is offset onto an exhaust port 32 side with respect to the rotational center of a crankshaft, wherein the offset amount of the shaft center with respect to the rotational center is greater than 1 mm and less than 6 mm.

In the two-cycle engine of the present invention, the center of gravity of a counterweight of the crankshaft is ideally offset onto the rear side in the rotational direction with respect to the line passing the rotational center of the crankshaft and the center of a crank pin.

Herein, "the rear side in the rotational direction" means the delay side in terms of the crank angle and the "front side in the rotational direction" in an embodiment to be described later means the advancing side in terms of the crank angle.

Effects of the Invention

According to the present invention, in case of having an offset structure, because the offset amount is optimally set as an engine for portable working machines, explosive forces may efficiently be transmitted to the crankshaft by positioning the shaft center of the cylinder and the shaft center of the con.rod at the time when the pressure inside the cylinder reaches a maximum at a crank angle, and the piston is also more delayed than conventional ones with respect to the crank angle, making it possible to improve the combustion efficiency due to its capability of sufficient combustion in a state in which the piston is at a high position close to the top dead center side, that is, in a state before the exhaust port begins to open. Furthermore, because uncombusted fuel may be reduced as a result of assuring combustion, the uncombusted fuel discharged together with exhaust gas may be further reduced and the emissions may be improved.

In the present invention, there is an effect in which it is made possible to reduce vibrations when the center of gravity of a counterweight is shifted onto the rear side in the rotational direction, because the piston may be moved smoothly at the time of passing the top dead center of the piston or when the pressure inside the cylinder reaches the maximum.

EMBODIMENTS OF THE INVENTION

Embodiment 1

Figure 1:
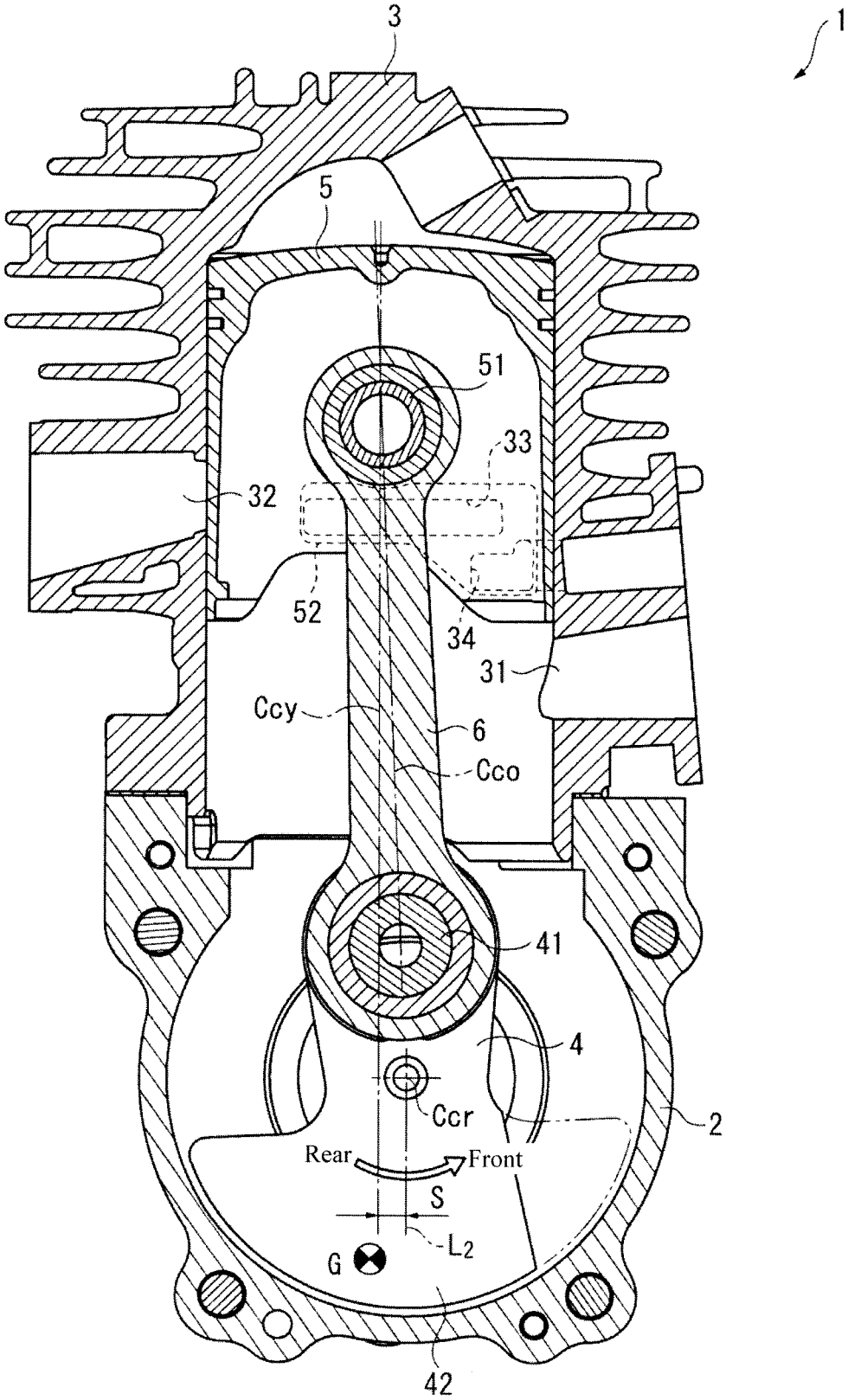
FIG. 1 This is a longitudinal cross-section drawing showing a two-cycle engine pertaining to Embodiment 1 of the present invention.

Hereinafter, a two-cycle engine 1 pertaining to Embodiment 1 of the present invention is described (hereinafter, simply referred to as "engine") based on FIG. 1. It should be noted that in the following description, movement onto the TDC (Top Dead Center) side of a piston 5 to be described later is referred to as ascending, whereas, movement onto the BDC (Bottom Dead Center) side is referred to as descending.

An engine 1 is a single cylinder engine comprising a crank case 2, a cylinder 3 secured onto the crank case 2 using bolts via a gasket, a crankshaft 4 that is axially supported within the crank case 2 so as to be rotatable, a piston 5 housed slidably in the cylinder 3, and a con.rod 6 with one end axially supported by a crank pin 41 of the crankshaft 4 and the other end axially supported by a piston pin 51 of the piston 5.

Said engine 1 is favorably used for a chainsaw, a bush cutter, an engine blower, and other handheld type or backpack type portable working machines. It is also possible to apply the engine 1 to a hobby engine, etc. for radio control.

Furthermore, the engine 1 in the present embodiment is configured as a stratified scavenging two-cycle engine. That is, for the cylinder 3 of the engine 1, a piston valve-type suction port 31, exhaust port 32, and scavenging port 33 are provided and, in addition, an air port 34 for sending leading air (pure air) for stratified scavenging into a scavenging passage (not illustrated) is provided in the upper part of the drawing of the suction port 32.

When the piston 5 is ascending, at the same timing as opening of the suction port 31, the leading air transported into the air port 34 flows into a concave-shaped communicating passage 52 provided on the outer peripheral surface of the piston 5, enters into the scavenging passage from the scavenging port 33 side through the communicating passage 52, and stays in the vicinity of the scavenging port 33.

As a result, prior to the mixed air from the crank case 2, the leading air flows into the cylinder first when the piston switches to descending. Therefore, there is a possibility that the leading air not containing fuel might escape from the exhaust port 32 that begins to open when the leading air and the mixed air flow in, making it difficult for the subsequently entering uncombusted mixed air following the leading air to escape and improving exhaust gas emissions.

In addition, an offset structure is adopted in the engine of the present embodiment in order to further improve emissions and engine output. That is, the shaft center $C_{cy}$ of the cylinder 3 is shifted to a parallel position offset by the offset amount S onto the exhaust port 32 side with respect to the rotational center $C_{cr}$ of the crankshaft 4. It should be noted that in FIG. 1 and FIG. 2, the line parallel to the shaft center $C_{cy}$ of the cylinder 3 passing the rotational center $C_{cr}$ of the crankshaft 4 is indicated as $L_2$.

The offset amount S in the present embodiment is 3 mm. In a single cylinder two-cycle engine for portable working machines, the range of the amount of exhaust, the length of con.rod, and the radius of the crank are approximately restricted and among these, if consideration is given to the radius of the crank, it is most preferable to set the offset amount S to be in the range of 1 mm□S□6 mm.

Specifically, in an engine used for the above purposes, it is known that the pressure inside the cylinder reaches the maximum at a position with 10° of ATDC (After Top Dead Center) in terms of the crank angle. Therefore, in the engine 1 in the present embodiment, as schematically shown in FIG. 2, the shaft center $C_{co}$ of the con.rod 6 and the shaft center $C_{cy}$ of the cylinder 3 are set to match at the position with 10° of ATDC where the pressure inside the cylinder reaches its maximum.

According to this setting, the explosive force for pushing the piston 5 onto the descending side may most efficiently be transmitted to the crankshaft 4 via the con.rod 6 along the shaft center $C_{cy}$ of the cylinder 3. As is clear from FIG. 2, if each of shaft centers $C_{cy}$ and $C_{co}$ match and if the crank radius is R, the offset amount S may be approximated at R sin 10°; consequently, S=3 mm is set in this embodiment. It should be noted that in FIG. 1, because the piston 5 indicates a state positioned at TDC, neither of the shaft centers $C_{cy}$ and $C_{co}$ match.

Figure 2:
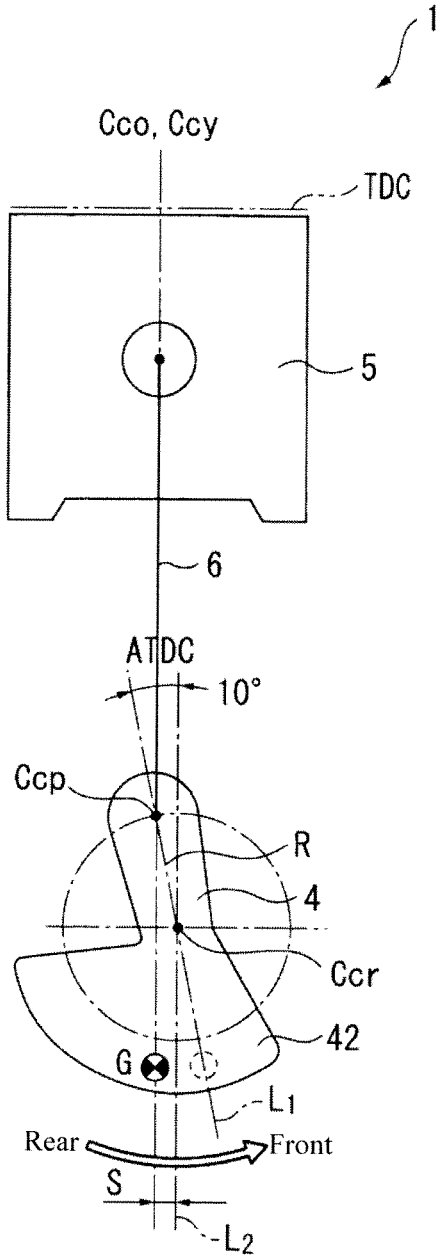
FIG. 2 This is a schematic drawing for describing the two-cycle engine in Embodiment 1.
Figure 3:
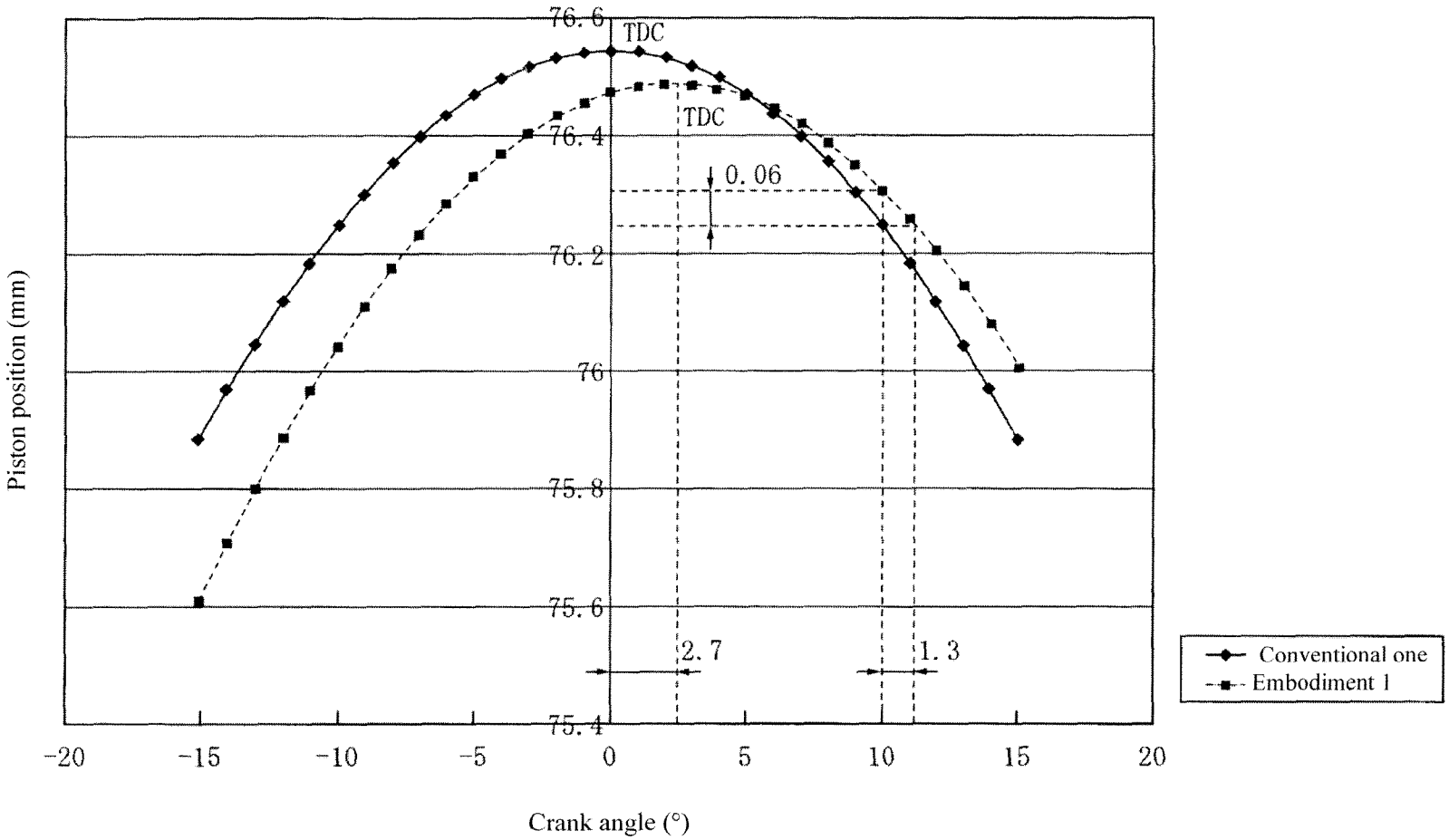
FIG. 3 This is a drawing of piston positions with respect to the crank angle comparing the two-cycle engine in Embodiment 1 to a conventional two-cycle engine.

Herein, the position of the piston 5 at 10° of ATDC is a slightly advanced (lower) position from the position of the TDC indicated by the dashed two-dotted line in FIG. 2, and the position still remains relatively close (high) to the TDC in comparison to conventional engines. FIG. 3 shows the relationship of piston positions with respect to the crank angle in a conventional engine not having an offset structure and the engine 1 in the present embodiment.

In FIG. 3, with reference to a conventional engine, the piston 5 of the engine 1 in the present embodiment reaches the TDC with a delay of 2.7° in the crank angle in comparison to the conventional one. Therefore, at 10° of ATDC where the pressure inside the cylinder reaches the maximum, the position of the one in the present embodiment is still closer to the TDC by 0.06 mm with a delay of 1.3° to reach the same position as the conventional one.

That is, it takes longer until the exhaust port 32 begins to open from the start of combustion triggered by ignition and, as a result, the opening of the exhaust port 32 opens after sufficient combustion.

Consequently, this excellent combustion improves combustion efficiency and, as described previously, also improves transmission efficiency of the explosive forces, leading to the increase in output. Furthermore, this excellent combustion reduces uncombusted fuel contained in the exhaust gas, thereby, making it possible to improve the emissions. Moreover, because the engine 1 is originally a stratified scavenging type with excellent emissions, the emissions may be remarkably improved as a result.

Furthermore, as described in the background technology or as also shown in FIG. 3, because the position of the TDC in the present embodiment is lower than a conventional one (the stroke and the compression ratio are the same), the length of the cylinder 3 may be shortened with an effect of making it possible to contribute to downsizing. As the side pressure of the periphery surface of the cylinder and the piston 5 become low, a lubricated state may favorably be maintained and seizures or abnormal wear may also be controlled.

Figure 4:
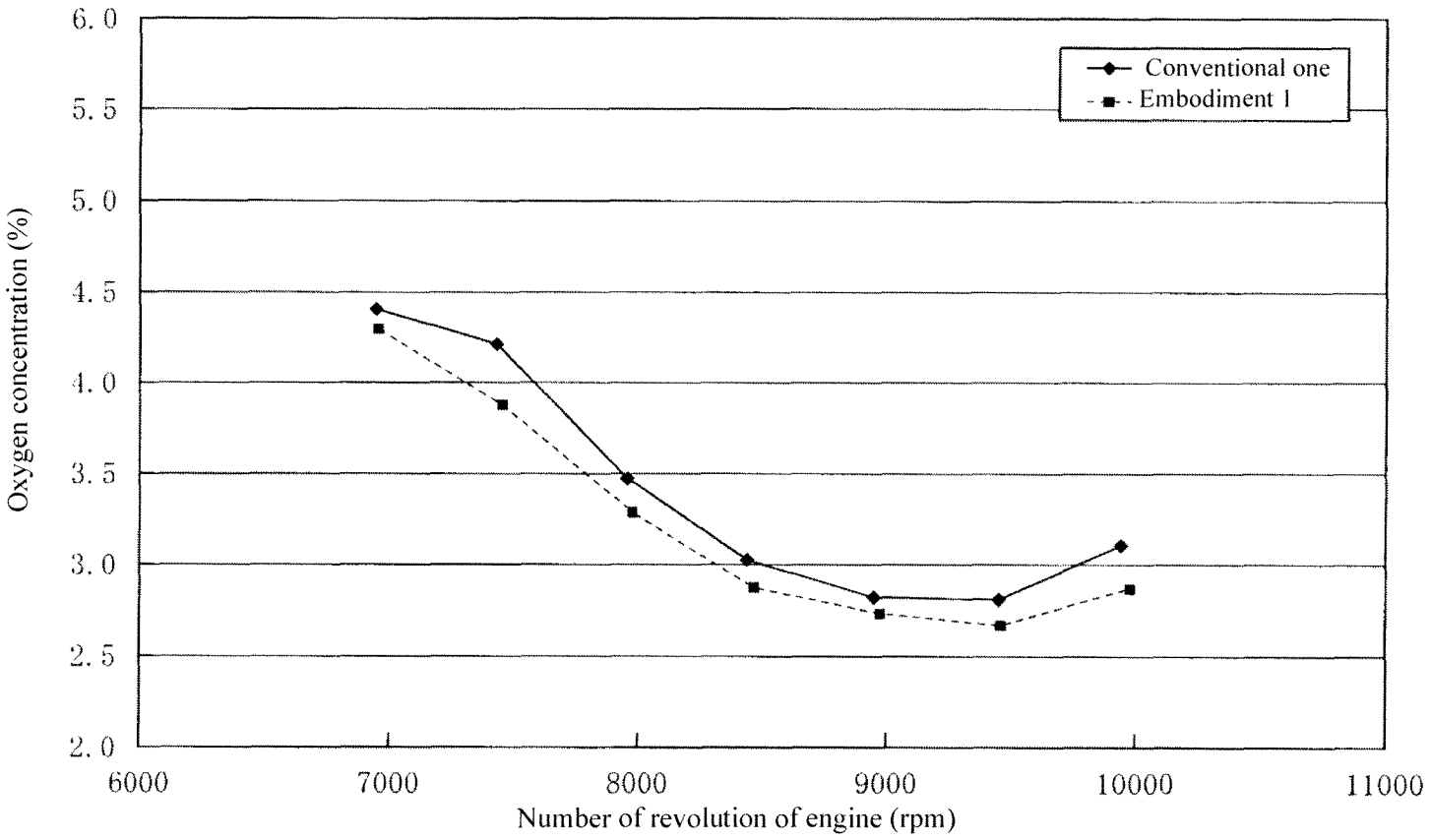
FIG. 4 This is a drawing showing the oxygen concentration contained in exhaust gas comparing the two-cycle engine in Embodiment 1 to a conventional two-cycle engine.

In FIG. 4, the oxygen concentration contained in the exhaust gas is shown comparing a conventional engine and the present invention. According to the figure, the engine 1 in the present embodiment shows a lower oxygen concentration than the conventional engine when the engine revolution most frequently used is 7,000 to 10,000 rpm. This means that the amount of oxygen is reduced further as a result of excellent combustion and improvement of the output.

Figure 5:
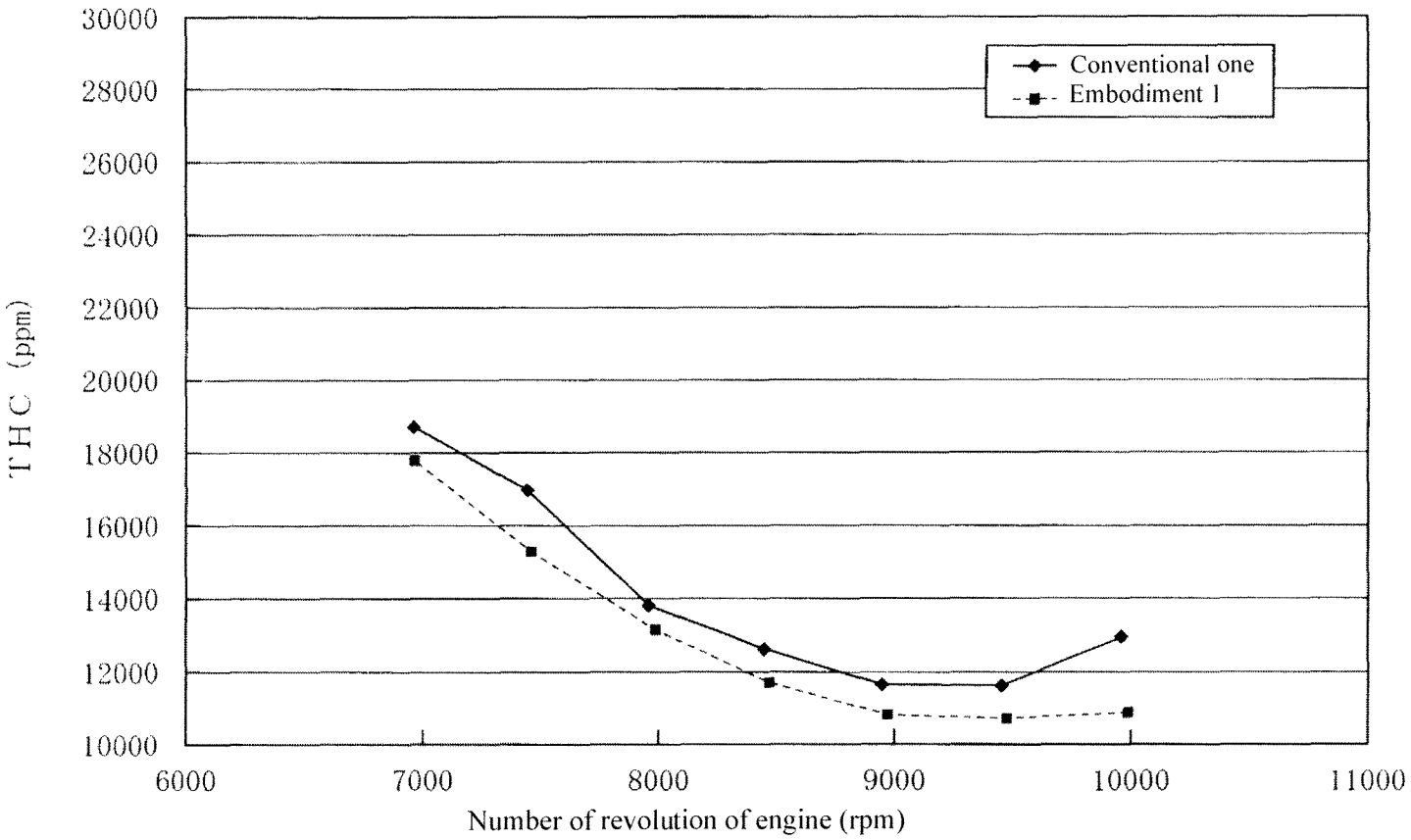
FIG. 5 This is a drawing of THC (Total Hydrocarbon) contained in exhaust gas comparing the two-cycle engine in Embodiment 1 to a conventional two-cycle engine.
Figure 6:
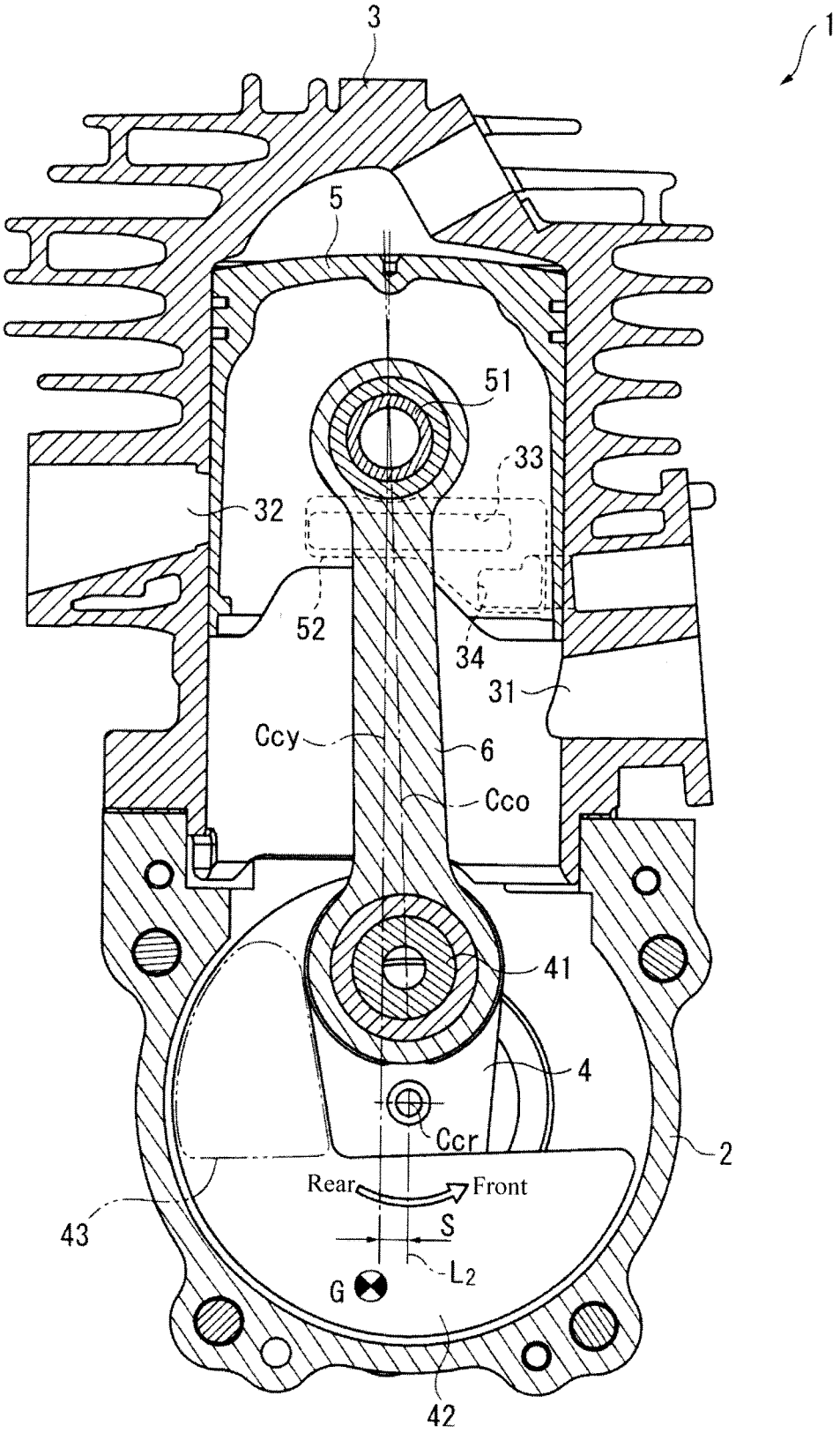
FIG. 6 This is a cross-section drawing showing a two-cycle engine pertaining to Embodiment 2 of the present invention.

Moreover, FIG. 5 shows the total hydrocarbons (THC) contained in the exhaust gas comparing a conventional engine and the present embodiment. Also in this figure, the total hydrocarbons with the engine 1 in the present embodiment are lower than conventional engines in the same revolution region. This is also a result of excellent combustion and it may be concluded that less uncombusted fuel improved the exhaust gas emissions.

Incidentally, in the previous FIG. 1 and FIG. 2, the position of the center of gravity G of the counterweight 42 is offset onto the rear side in the rotational direction from the line $L_1$ passing the rotational center $C_{cr}$ of the crankshaft 4 and the center $C_{cp}$ of the crank pin 41 (FIG. 2). The rotational direction of the crankshaft 4 is indicated using an outline arrow in FIG. 1 and FIG. 2. The location of the conventional center of gravity G is indicated with a small dotted circle in FIG. 2.

More specifically, the center of gravity G is set such that when the piston 5 is in a position at TDC or 10° of ATDC, it is positioned between the vicinity extending from the shaft center $C_{cy}$ of the cylinder 3 and the vicinity on the line $L_2$ parallel to the shaft center $C_{cy}$ passing the rotational center $C_{cr}$ of the crankshaft 4.

For this reason, the counterweight 42 is made to be asymmetrical with respect to the line passing the rotational center $C_{Cr}$, of the crankshaft 4 and the center $C_{Cr}$ of the crank pin 41. In the present embodiment, a shape from which the front side in the rotational direction is deleted from a conventional counterweight is applied. The portion indicated by the dashed two-dotted line in FIG. 1 is equivalent to the deleted portion.

Because the piston 5 switches from ascending to descending bordering the TDC, vector movement changes of the piston 5 as well as speed changes (acceleration) of a portion of the reciprocally moving piston 5, etc. are significant and the influence on vibrations is great. Furthermore, even at the time when the pressure inside the cylinder reaches the maximum (ATDC is 10°) at which time the composite force of the explosive force and inertial force of the reciprocally moving piston 5, etc. becomes great in the engine 1, vibration acceleration becomes great due to the behavioral changes at the reciprocally moving portion affected by the pressure inside the cylinder to the reciprocally moving portions such as the piston 5, etc.

Therefore, from the time when the piston 5 moves from the TDC to 10° of ATDC, in the present embodiment, wherein the center of gravity G of the counterweight 42 is located between the vicinity extending from the shaft enter $C_{cy}$ of the cylinder 3 and the vicinity of the line $L_2$ parallel to the shaft center $C_{cy}$ passing the rotational center $C_{cr}$ of the crankshaft 4, the piston 5 may be slid in the descending direction along the shaft center $C_{cy}$ with good balance, preventing vibrations from becoming greater.

Embodiment 2

FIG. 5 shows an engine 1 pertaining to Embodiment 2 of the present invention. In the previous Embodiment 1, the position of the center of gravity G is shifted onto the rear side of the rotational direction as a result of deleting the front side in the rotational direction with respect to a conventional counterweight; however, in the present embodiment, a counterweight 42 is configured by providing an additional part 43 (refer to the dashed two-dotted line in the figure) onto the rear side in the rotational direction with respect to a conventional counterweight.

Also in the present embodiment, when the piston 5 reaches 10° of ATDC from the TDC, the center of gravity G may be positioned between the vicinity extending from the shaft center $C_{cy}$ of the cylinder 3 and the vicinity of the line $L_2$ parallel to the shaft center $C_{cy}$ passing the rotational center $C_{cr}$ of the crankshaft 4, resulting in the same effects as in Embodiment 1 being obtained with regard to the reduction of vibrations.

It should be noted that the present invention is not limited to each previously described embodiment and all modifications, etc. within the range in which the purpose of the present invention is achievable are included in the present invention.

For example, the engine 1 in each aforementioned embodiment was a two-cycle engine of a stratified scavenging type but said engine may also be a conventional two-cycle engine that is not a stratified scavenging type.

In each previous embodiment, the position of the center of gravity G is shifted by providing a deleted portion or additional part 43 with the counterweight 42, but the position of the center of gravity may also be changed by providing a counterweight line symmetric to a line passing the rotational center of a crankshaft and the center of a crank pine and shifting the same onto the rear side in the rotational direction. However, the position of the crank pin is not supposed to be changed.

Furthermore, a counterweight like conventional ones, that is, a counterweight whose center of gravity is located on the line passing the rotational center of the crankshaft and the center of the crank pin, may also be adopted depending on the vibration level of the engine, with such a case also included in the present invention.

INDUSTRIAL APPLICABILITY OF THE INVENTION

The two-cycle engine of the present invention may be used in an engine for portable working machines such as a chainsaw, bush cutter, engine blower, trimmer, edger, etc. or for hobby use.

EXPLANATION OF THE SYMBOLS

1 . . . two-cycle engine, 3 . . . cylinder, 4 . . . crankshaft, 32 . . . exhaust port, 41 . . . crank pin, 42 . . . counterweight, $C_{cp}$ . . . shaft center, $C_{cr}$ . . . rotational center, $C_{cy}$ . . . shaft center, G . . . center of gravity, $L_1$, $L_2$ . . . line, S . . . offset amount

What is claimed is:

1. A two-cycle engine having a structure in which a shaft center of a cylinder is offset onto an exhaust port side with respect to a rotational center of a crankshaft, wherein an offset amount of the shaft center with respect to the rotational center is greater than 1 mm and less than 6 mm, and a center of gravity of a counterweight of the crankshaft is shifted onto a rear side in the rotational direction with respect to a line passing the rotational center of the crankshaft and a center of a crankpin.

2. A two-cycle engine having a structure in which a shaft center of a cylinder is offset an amount onto an exhaust port side with respect to a rotational center of a crankshaft, wherein a center of gravity of a counterweight of the crankshaft is shifted onto a rear side in the rotational direction with respect to a line passing the rotational center of the crankshaft and a center of a crankpin.

* * * * *